US005165533A

United States Patent [19]

Wilentchik, deceased et al.

[11] Patent Number: 5,165,533

[45] Date of Patent: Nov. 24, 1992

[54] SCREW CONTROLLED CONTACT MECHANISM

[75] Inventors: Jerzy J. Wilentchik, deceased, late of Yonkers; by Rose Waldorf, executrix, New York; by Murray Sender, executor, Yonkers, all of N.Y.

[73] Assignee: Consolidated Resource Corp. of America, Inc., Yonkers, N.Y.

[21] Appl. No.: 182,902

[22] Filed: Apr. 18, 1988

[51] Int. Cl.[5] ..... H01H 3/40

[52] U.S. Cl. ..... 200/500; 200/507

[58] Field of Search ..... 200/500, 507, 572

[56] References Cited

U.S. PATENT DOCUMENTS

| | | | |
|---|---|---|---|
| 1,173,099 | 2/1916 | Davis | 200/572 |
| 2,854,552 | 9/1958 | Gouverneur, II | 200/507 X |
| 2,874,248 | 2/1959 | Tondat et al. | 200/572 X |
| 4,004,119 | 8/1975 | Latour | 200/158 |
| 4,027,128 | 11/1975 | Walker | 200/158 |
| 4,639,566 | 1/1987 | DeHaitre | 200/507 |
| 4,713,498 | 12/1987 | Ludwig et al. | 200/507 X |

FOREIGN PATENT DOCUMENTS

| | | | |
|---|---|---|---|
| 4465 | of 1883 | United Kingdom | 200/572 |
| 174480 | 2/1922 | United Kingdom | 200/507 |

*Primary Examiner*—Henry J. Recla
*Assistant Examiner*—David J. Walczak
*Attorney, Agent, or Firm*—Charles E. Temko

[57] ABSTRACT

A screw operated electrical contact device having at least one pair of electrical conductors disposed on and projecting evenly above a dielectric surface, an insulation gap separating said conductors from each other, a nut attached to or part of the dielectric surface, having a center axis perpendicular to the surface aligned with the gap, a screw in threaded engagement with the nut, the screw being adapted to be moved along the length of the axis as it is rotated about the axis in the nut, and a contact dimensioned to bridge the gap, mounted fixedly and insulatingly in the screw, adapted to connect the conductors electrically together by exerting simultaneous pressure on both of them as a result of advancement of the contact toward the surface caused by the screw being rotated about the axis.

1 Claim, 6 Drawing Sheets

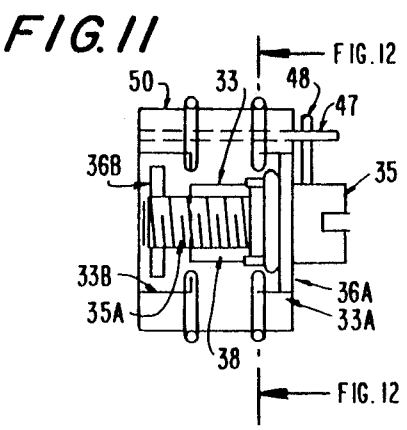
FIG. 11
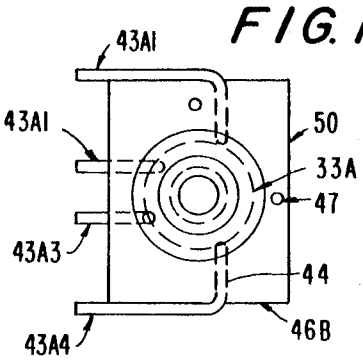
FIG. 12
FIG. 15
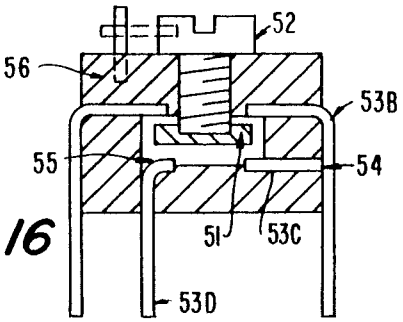
FIG. 16
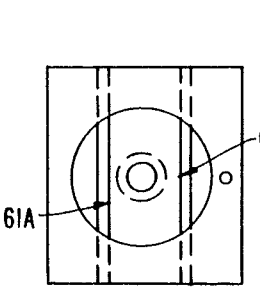
FIG. 19
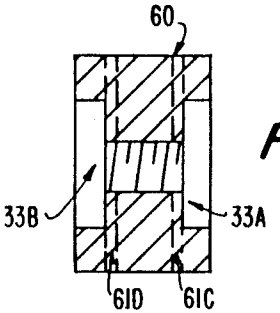
FIG. 18
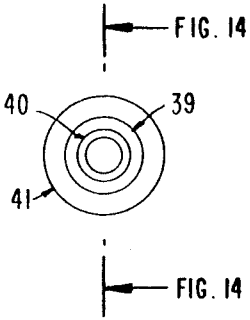
FIG. 13
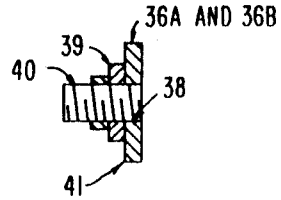
FIG. 14
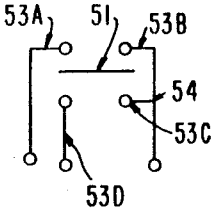
FIG. 17
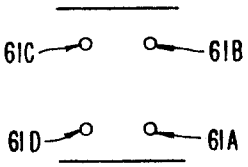
FIG. 20

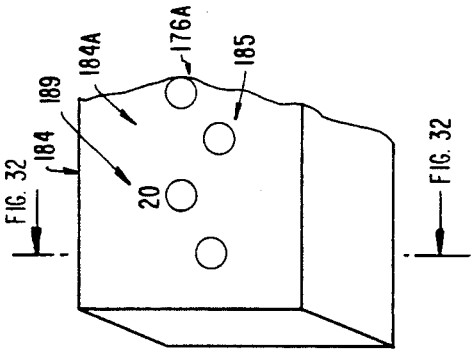
FIG. 31
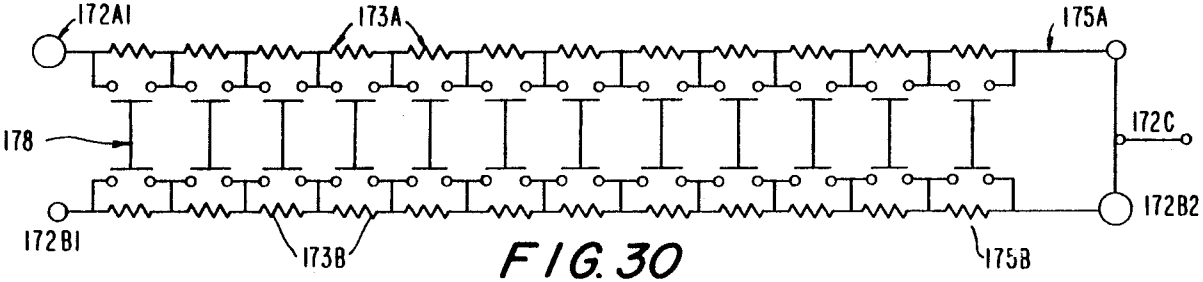
FIG. 30
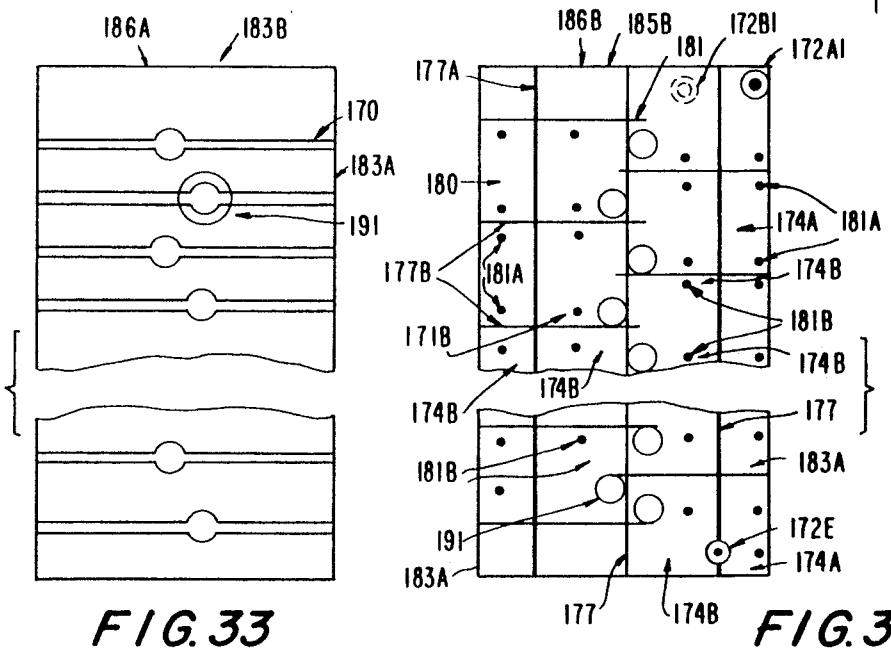
FIG. 34
FIG. 33
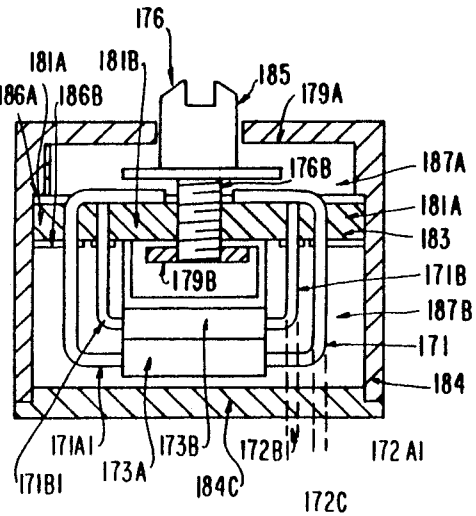
FIG. 32

SCREW CONTROLLED CONTACT MECHANISM

BACKGROUND OF THE INVENTION

This invention relates to the application of screw controlled contacts to all types of devices and particularly to miniature electric switches, where the operator selects, out of many controlled circuits, those to be opened or closed by manually actuated switch contacts. There are known in the art, miniature slide and rocker switches performing functions outlined above, however, the pressure between their contacts in the "ON" position is very light in order to insure easy adjustment and long life. This in turn causes their contact resistance to vary from 30 to 100 milliohms, precluding their usage in applications requiring current switching capability of more than a couple of hundred milliamps and also in precision resistance circuits, where minute resistance variations could affect overall circuit accuracy such as in decades, bridges, dividers and testers using resistors, inductors and capacitors of low ohmic, high current and/or capacitive and inductive values.

There are also known in the art, screw acuated switches such as described in U.S. Pat. No. 4,027,128 granted on May 31, 1977 to Richard B. Walker, or U.S. Pat. No. 4,004,119 granted on Jan. 18, 1977 to Marc R. Latour which bypass the disadvantages outlined above, but which have their own problems; precluding wide application, such as:

a. Switch functions which are limited to printed circuits and "on-off" operations.

b. There is no way of knowing whether the switch is "on" or "off" just by looking at it.

c. The screw contact is all metal, therefore, capable of causing electric shock to an unsuspecting user. (When used in High Voltage circuits).

d. The screw contacts can be easily removed and misplaced, making the switch inoperable.

e. Switch construction is such that switch widths of 0.100" are not feasible, although required by the electronic industry.

Switches available in the art are generally limited to only a few specific combinations of poles and positions because of the molding process used in making switch housings. The molding process requires substantial capital investment in tooling and is suitable for mass production of identical parts but not for many design variants required by the industry.

Rocker and slider switches available in the art are also limited to a certain maximum number of poles and positions, because frictional resistance, which is directly proportional to the number of poles, renders some switches with large numbers of poles inoperable when ganged together. Similar considerations apply to switch life which, due to wear of sliding contacts, becomes considerably shorter in conventionally designed switches as the number of switch positions increases.

SUMMARY OF THE INVENTION

The switch according to my invention overcomes all of the above mentioned disadvantages, yet is miniature in size, simple and inexpensive to make.

A major object of this invention is to provide a switch contact mechanism of a construction described hereinafter, having stable internal resistance in the order of one milliohm, capable of switching currents from a few microamps to several amperes.

Another object is to prevent electrical shock to persons using the switch in high voltage circuits, and to prevent shorting to adjacent circuitry during use; by providing screw(s) and/or contact mechanism(s) that are insulated.

A tertiary object of this invention is to enhance switch reliability through a high pressure, rotary wiping action. The switch resembles essentially a binding post capable of exerting contact pressure many times that found in conventional switches. This high pressure, in conjunction with a rotary wiping action are responsible not only for low and stable contact resistance but also for the crushing and removal of non-conductive oxide or sulphide films which might have formed on the switch contacts during extended periods of inaction which increases performance reliability, particularly at low energy levels.

Yet another object of this invention is to provide visual means for identifying "open" or "closed" switch contact positions. An object of the invention is to hold together all the assembly parts of the switch in an enclosed manner so that they not be removed or misplaced by the user and wherein the user is further assured of not receiving an electric shock during operation of the switch contacts; and to prevent contamination of the contacts by external dirt and grime.

Another object of this invention is to provide a switch design in which the number of individual poles and positions is limited only by dimensional considerations and not by frictional resistance or by excessive wear of switch contacts.

Still another object of the invention is to provide a customized switch construction wherein a few inexpensive tools accommodate wide variations in the number of poles and positions.

Also, another object of this invention is to provide a screw actuated switch, which on account of its small size, low cost and low internal resistance is suitable when used in conjunction with discrete components such as found in resistance, capacitance decades, voltage dividers, inductive, capacitive and resistive bridges and related test equipment.

BRIEF DESCRIPTION OF THE DRAWING

In the drawing, to which reference will be made in the specification, similar reference characters have been employed to designate corresponding parts throughout the several views.

FIG. 11 is a sectional view of a four circuit single pole double throw switch according to the invention.

FIG. 12 is a view of the switch body taken along the lines 12—12 of FIG. 11 with the screw actuator and contacts removed.

FIG. 13 is a front view of a contact 36*a* according to FIG. 9.

FIG. 14 is a sectional view of the contact 36*a* taken along lines 14—14 of FIG. 13.

FIG. 15 is a schematic diagram of switch circuit of FIG. 11.

FIG. 16 is a sectional view of a single pole, double throw switch according to the invention.

FIG. 17 is a schematic diagram of switch circuit of FIG. 16.

FIG. 18 is a sectional view of a leadless switch body according to the invention with the actuating screw and contacts removed.

FIG. 19 is a side view of switch body according to FIG. 18.

FIG. 20 is a view from above of the switch body contacts according to FIG. 16.

FIG. 30 is a schematic of a voltage divider/variable resistor circuit according to the invention.

FIG. 31 is a perspective, partly cutaway view of the Resistor/Divider according to FIG. 30.

FIG. 32 is a sectional view of the divider's interior design taken along lines 32—32 of FIG. 31.

FIG. 33 is a partly cutaway view of face 186*b* of the board 183 according to FIG. 32.

FIG. 34 is a partly cutaway view of the face 186*a* of the board 183 of FIG. 32.

DETAILED DESCRIPTION OF THE INVENTION

Figure 1:
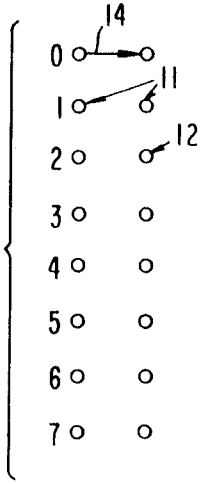
FIG. 1 is a schematic diagram of a single pole, multicircuit selector switch circuit according to the invention.

Referring first to FIG. 1 there is shown an array of eight uniformly spaced pairs 11, of stationary contacts 12 with a bridging contact 14 adapted to connect any pair 11 of contacts 12 electrically together. The contact 14 is movable from one end of the contact array to the other end thereof and the operator can select to have the contacts 12 of any one pair 11 connected by the contact 14 as his needs may require.

Figure 2:
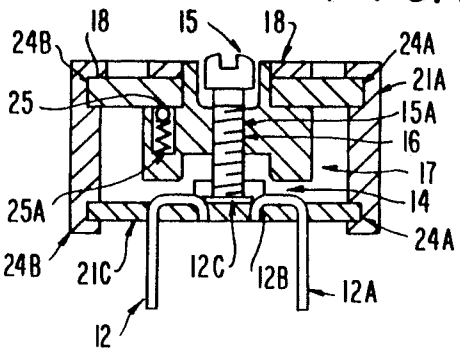
FIG. 2 is a sectional view of the switch according to FIG. 3.
Figure 3:
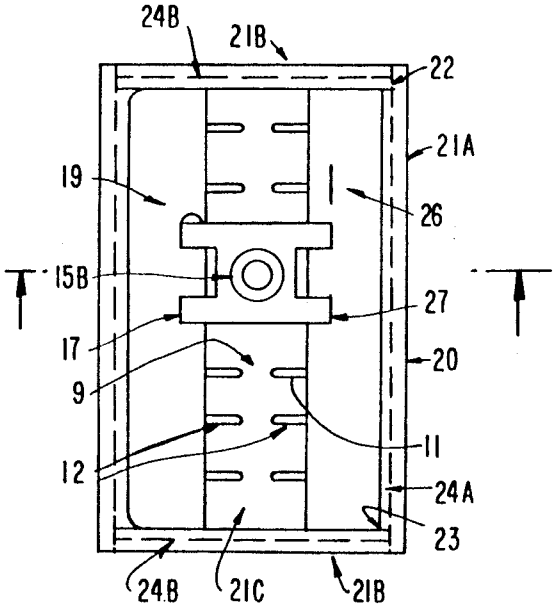
FIG. 3 is a view of the switch from the top according to FIG. 2.

Referring now to FIG. 2 shows the bridging contact 14 permanently mounted at the end of a threaded shank 15A of a screw 15. The shank 15A remains in threaded engagement with the threads of a tapped hole 16 thru the center of a dielectric slider carriage 17. Instead of threading the hole 16, an internally threaded metal bushing could be inserted into it in order to fulfill the same function. The carriage 17 is provided with a pair of internal "U" shaped projections 18 dovetailing with a pair of stationary panels 19 acting as rails to support the carriage 17 as it is moved along the length of the panels 19. Referring now to FIG. 3, the panels 19 constitute the top of a rectangular shaped enclosure 20 comprised of a pair of long dielectric walls 21A at right angles with a pair of short dielectric walls 21B and of an insulating bottom panel 21C. The walls 21A have milled ends 22 dovetailing with walls 21B and are held together by epoxy fillets 23 in respective inside corners of the enclosure 20. Each of the walls 21A and 21B is furnished with a pair of respective parallel grooves 24A and 24B extending the entire length thereof about 1/32" away from their respective edges. The depth of the grooves 24A and 24B is about half of their wall thickness and their width is equal to or slightly larger than the width of the panels 19 and the bottom panel 21C. The panels 19 and the bottom plate 21C being of the same thickness are inserted into the grooves 24A and 24B and cemented therein. This type of construction tends to strengthen the enclosure 20 against stresses exerted by the screw 15 when it is tightened against the bottom panel 21C. The panel 21C is provided with eight pairs 11 of "U" shaped semirigid wires or pins having one leg 12A longer than the other leg 12B. Both legs are inserted into respective holes in the panel 21C. The leg 12A being cemented into place and protruding outwardly, while the leg 12B is level with the external surface of the panel 21C and uncemented. The protruding legs 12A form a dual in-line pin pattern providing 0.100"×0.300" spacing which is a standard for the electronic industry. It is understood that the sections 12C which connect the legs 12A and 12B in respective wires 12 protrude uniformly above the internal surface of the panel 21C by an amount approximately equal to their diameter. It is further understood that the connecting sections 12C are not cemented in place to allow them to yield to pressure of contact 14.

The screw 15 can be of dielectric material such as nylon and the contact 14 can be a disc made of electrically conductive material having either a tapped or a blind hole thru center for fixed mounting on the shank 15A either by threading or by press fit with additional assistance of cement or by pinning thru center (not shown). In an alternative design the screw 15 can be metallic and the contact 14 compromises a dielectric disc having a layer of copper or other conductive metal laminated to one of its large surfaces, then have center section counterbored to avoid electrical contact with the shank of the screw. To position the contact 14 directly vis-a-vis a gap 9, separating the respective pair 11 of contacts 12, a detent mechanism is employed comprised of a spring loaded ball 25 housed in a blind hole 25A in the carriage 17 cooperating yieldingly with an array of indentations or blind holes in one or both of the panels 19 spaced opposite each other; the distance between a pair 11 of adjacent contacts 12 being such and registered in such manner that as the carriage 17 is moved along the panels 19, the ball 25 will encounter the blind holes or indentations in the panel 19 creating tactile sensation allowing the operator to identify blindly the various positions of the slider at which the contact 14 is positioned opposite a respective pair of contacts 11. The contact 14 is disc shaped, having a diameter somewhat larger than the gap separating a pair 11 of affiliated contact wires 12, but somewhat smaller than the distance between any first and third same array wires 12. When the screw 15 is turned clockwise, the contact 14 is advanced towards the panel 21C until it presses against the wire connecting sections 12C, of a respective contact pair 11 thereby connecting them electrically together. It is pointed out that the sections 12C are not cemented in place which allows them to "breathe" or respond yieldingly to the pressure exerted by the contact 14 which tends to push them against the hard surface of the panel 21C. Turning the screw 15 counterclockwise breaks the connection between the pair 11 of wires 12. The contact 14 is mechanically fastened or cemented to the shank 15A which prevents the removal of the screw 15 from the threaded hole 16. The panels 19 may be imprinted with a scale 26 and the top of the slider carriage 17 may be provided with a centrally located cutout 27 to allow identification of slider position per scale 26. It will be understood that the switch construction described in reference to FIGS. 1, 2 and 3 uses simple parts which can be produced with the assistance of basic machine shop tools such as shear, press, drill and milling machines. It is further understood that virtually any wanted number of switch positions can be realized by varying switch's length which necessitates variations in the length of panels 19, walls 24A and bottom plate 21C, but no other substantial design changes. Thus, it is shown that the switch construction is easily adaptable to changes in the number of switch positions without requiring major tool up.

The switch construction will also accomodate a varying number of poles by extending the length of the slider and providing it with additional tapped holes in which screw controlled contacts can be located. A schematic of a two pole, four position switch is shown in FIG. 4 with common output wires.

Figure 6:
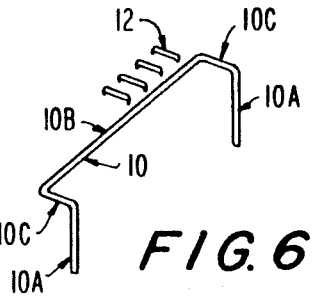
FIG. 6 is a perspective view of a common bus wire to be used in the circuit of FIG. 4.

In the schematic of FIG. 1 each pair 11 of wires 12 constitutes a separate circuit. In the diagram of FIG. 4 there are two circuits each composed of four input and one output wires. FIG. 6 shows the outline of the common output bus wire 10 consisting of a pair of legs 10A, a wiping section 10B and two connecting sections 10C. It is understood that the wiping section 10B is of the same diameter as the diameter of the wires 12 and that either one or both of the legs 10A protrude outwardly thru respective holes in the bottom panel 21C. Only the legs 10A and the connecting sections 10C are cemented to the panel 21C while the section 10B is free to breathe. When the switch is closed, the contact 14 bears pressure on one of the four input wires 12 of FIG. 4 and on a small segment of the common bus wire 10 connecting them electrically together. Since the diagram of FIG. 4 shows two separate circuits, the slider carriage shown as 17A in FIG. 5 is made considerably longer than the carriage 17 of FIG. 2 in order to accomodate two screws 15 with their contacts 14 spaced from each other by a distance equal to the spacing between the first wires of the two electric circuits of FIG. 4. Other details of construction are essentially the same as described in reference to FIGS. 1, 2 and 3, their explanation is therefor dispensed herewith.

Figure 7:
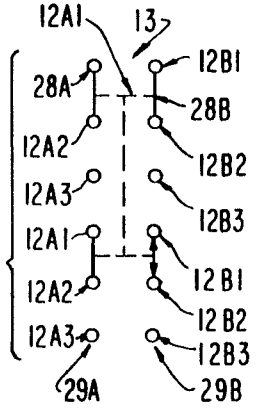
FIG. 7 is a schematic diagram of a four pole double throw switch circuit according to the invention.
Figure 4:
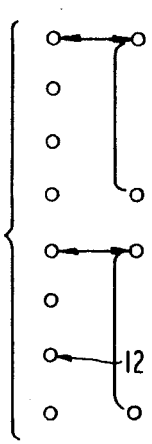
FIG. 4 is a schematic diagram of a two pole four position switch circuit according to the invention.
Figure 5:
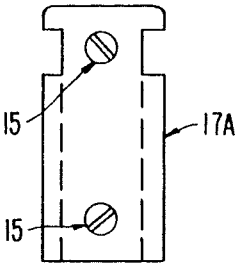
FIG. 5 is a top view of a slider to be employed in the circuit of FIG. 4.

It will be understood by those skilled in the art that the general design of the double pole four position switch of FIG. 4 can be easily modified along similar lines to provide not two but any wanted number of circuits without departing from the invention, the only limiting factor being dimensional considerations. It will be further understood that in the circuits of FIG. 1 and 4, the elevation of the head of the screw 15 above the carriage 17 is a visual indicator as to whether the contact 14 connects a pair of wires 12 or not. As an alternative indicator as to whether the switch contacts are open or closed, a color dot can be painted on the carriage 17 of FIG. 3 to coincide, in the closed contacts position, with a dot painted on the head 15B of the screw 15. FIG. 7 is a schematic of another embodiment of the sliding switch applicable to double pole, double throw uses. In this embodiment the movable contact 28 of a switch 13 is seen FIG. 8 and is composed of two contact sections insulated from each other, 28A and 28B. The contact section 28A does not rotate and connects stationary contacts 12 in the row 29A and the section 28B stationary contacts 12 in the row 29B, the design of contacts 12 having been already described in reference to FIGS. 1, 2 and 3. For ease of explanation, the wires 12 in the row 29A are assigned designating numerals 12A1; 12A2; 12A3 and the wires 12 in the row 29B the numerals 12B1, 12B2 and 12B3. The switch has only two slider positions. In position #1, the contact 28A connects the wires 12A1 to 12A2 and the contact 28B, the wires 12B1 to 12B2. In position #2 the contact 28A connects the wires 12A2 to 12A3 and the contact 28B the wires 12B2 to 12B3. The switch 13 shown in FIG. 7 has six pairs 11 of stationary contacts 12 and two bridging contacts 28 providing two double pole, double throw switches. It is understood that in this arrangement each pole or bridging contact 28 controls a section of three pairs of contacts 12. Each such section constitutes a double pole double throw switch. The number of such sections is a choice of the designer, the only limiting factor being dimensional consideration. The design of the switch is essentially similar to the one described in reference to FIGS. 2 and 3, subject to following exceptions:

1. Switch 13 has only six pairs 11 of contact 12.

2. There are only two needed detent holes in the panel 19 to provide the stationing of the contact 28 in one of two positions: In position #1 the contact 28 is positioned midway between stationary contacts 12A1; 12A2; 12B1 and 12B2 and in position #2 midway between contacts 12A2; 12A3; 12B2; 12B3.

Figure 8:
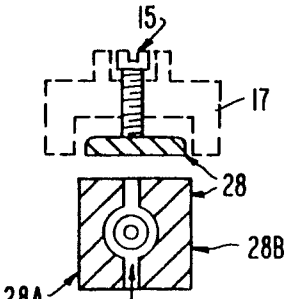
FIG. 8 is a view of a contact disc to be employed in conjunction with the switch circuit of FIG. 7.

3. The contact 28 shown in FIG. 8 is a square shaped plate of material dielectric, having a layer of conductive metal such as copper, or bronze laminated or otherwise attached to one of its large surfaces, separated by an insulating groove 28C into a pair of segments 28A and 28B. In either contact position #1 or #2 the length of the segments 28A and 28B is adequate for bridging the gap between two adjacent stationary wires 12 but not long enough for touching other wires 12 in the arrays 29A and 29B. The contact 28 is registered in such manner on carriage 17 so as to align with position #1, the segment 28A connects the wire 12A2 to wire 12A1 and the segment 28B the wire 12B2 to wire 12B1. In position #2 the wires 12A2 and 12A3 are connected by the segment 28A and the wires 12B2 and 12B3 by the segment 28B. The mounting of the contact 28 on the shank 15A is accomplished by reducing the diameter of the screw 15A at the mounting end, drilling a plain hole in contact 28, larger than screw mount diameter to allow contact 28 to rotate freely at end of screw 15A. Contact 28 is staked onto end of screw 15A to prevent its falling off, yet still be allowed to rotate freely.

4. The slider carriage shown in FIG. 5 is longer than the carriage 17 in order to accomodate a pair of screw operated contacts 28 spaced from each other by a distance equal to the spacing between the first wires of two electric circuits of FIG. 7.

The mechanical switch arrangement of FIG. 2 is applicable, subject to minor modification in the panel 21C as a code switch suited to produce BCD and other types of code functions. A code switch consists of one common output terminal and several input terminals. In each switch position, the common output terminal is connected only to those input terminals scheduled for interconnection by a code preset into the switch during its assembly at the factory. The distinguishing feature of this code switch, besides its low contact resistance and high current carrying and switching capacity is the fact that it is not limited to a few standard codes only, but can accomodate any conceivable code within limits set by available input bus bars, with only one set of inexpensive tools, which makes it particularly useful in experimental and prototype applications. While the circuit of FIG. 1 provides a different pair of leads twelve to be connected together, in each switch position by the contact 14, there are up to five leads to be connected electrically in each switch position in the operation of the code switch according to the present invention.

Figure 9:
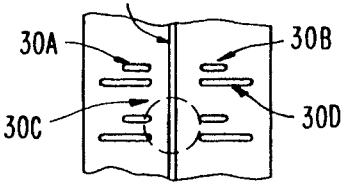
FIG. 9 is a partly cutaway view of panel 21C of FIG. 2 modified to provide layout of leads suited for coded switch applications.
Figure 10:
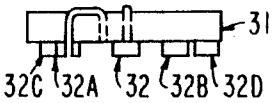
FIG. 10 is a sectional view of panel 31 of FIG. 9.

Referring now to FIGS. 9 and 10 a common bus bar wire 30 and up to four "U" shaped wire leads 30A; 30B; 30C and 30D substitutes for each pair 11 of leads 12 of FIGS. 1 and 2. The wire 30 extends along the center of a board 21 the latter being dimensionally simiar to panel 21C of FIG. 2 and made of G10 epoxy material or other suitable dielectric. The underneath surface of the board has five copper bus bars 32; 32A; 32B; 32C; and 32D laminated thereto and electrically insulated from each other.

The "U" shaped legs of respective wires 30A; 30B; 30C and 30D are located within respective clearance holes thru the board 31. One of the legs of the "U" shaped wires 30A; 30B; 30C; and 30D is slightly longer than the other leg for registration with the center and soldering to respective bus bars 32A; 32B; 32C and 32D while the other shorter legs do not quite reach the bus bars and remain unsoldered and insulated therefrom. The leads 30A and 30B are similar to each other and the length of the center section of their "U" is shorter than in leads 30C and 30D, the latter being otherwise similar to each other and to the leads 30A and 30B. The leads 30A and 30C are on the left hand side of the common bus bar wire 30 and the leads 30B and 30D on the right hand side thereof. The shorter legs of the "U" shaped wires 30A; 30B; 30C and 30D are placed in clearance holes adjacent to the bus bar wire 30 while the longer legs are placed furthest away from the wire 30. It is understood that during assembly of switch's individual component parts at the factory, the leads 30A; 30B; 30C and 30D are assembled for each switch position selectively as the code may require, with some switch positions having four leads, some fewer than four and some none at all. It is further understood that switch contact 14 shown in dotted line in FIG. 9 has diameter large enough to reach and connect electrically all the leads 30; 30A; 30B; 30C; and 30D when clamping them against the flat surface of the board 31. Thus, in each switch position, various leads assembled at factory according to switch's code are connected to the common lead 30 which in turn is connected thru an opening in the board 31 (not shown) to the bus bar 32. Pins (not shown) are press fitted into the board 31 at the center of respective bus bars and soldered thereto, to protrude outwardly and act as terminals to the switch.

Referring now to FIGS. 11 and 12 of the drawings there is shown another embodiment of my switch suitable for either a double pole/double throw or a single pole/double throw application. A rectangular-shaped, stationary block 50 made of dielectric material has a thru hole 33 thru center which is counterbored at both ends, the counterbore on the right hand side of the drawing 11 being designated as 33A and the counterbore at the left hand side as 33B. An internally threaded bushing 34 can be press fitted into the hole 33 or alternatively the hole 33 can be tapped to cooperate threadedly with the shank 35A of a nylon screw 35. It is understood that since the block 50 is stationary, the shank 35A of the screw 35 will move along the axis of the bushing 34 relative to rotation of the screw 35. The shank 35A is provided with two contact discs, the contact disc 36A in the counterbore 33A and the contact disc 36B in the counterbore 33B. The discs 36A and 36B have either a tapped or plain hole thru center and are attached to the shank 35A by threading or press fit with assistance of cement or by pinning thru center (not shown). The contact 36A is located directly underneath screw head 35B and the contact 36B at the end of the shank 35A. The contacts 36A and 36B can be metal washers or built up discs of PC material as noted in FIGS. 13 and 14, and are similar to each other. They have a centered, tapped hole 38 an insulated segment 39 and two conductive rings 40 and 41 that are insulated from each other by segment 39. The block 50 is provided with eight terminal leads arranged into a pair of arrays 42A and 42B of four terminals each. The arrays 42A has four terminal leads 43A1; 43A2; 43A3 and 43A4 and the array 42B has four terminal leads designated 43B1; 43B2; 43B3 and 43B4. The array 42A is controlled by the contact disc 36A and the array 42B by the disc 36B. In FIG. 12 the leads 43A1 and 43A4 are shown bent at right angle and having one of their ends inserted into the counterbore 33A thru hole 44 extending from the side 46A of the block 50 to the other side 46B thereof, the other of their respective ends projecting outside of the block 50 for connection to an outside voltage source (not shown).

The leads 43A2 and 43A3 are parallel to each other, and located in one plane with the leads 43A1 and 43A4. One of their ends is inserted thru a respective opening in the side 46C of the block 50 into the counterbore 43A while the other of their ends protrudes externally in line with the ends of the leads 43A1 and 43A4. The side 46C is at right angle to sides 46A and 46B. All the leads 43A1; 43A2; 43A3 and 43A4 can be plated copper or bronze cemented in place as they pass thru respective openings in the block 50. Those openings are arranged in one plane, therefor the ends of respective leads in the counterbore 33A are also in one plane. The spacing of the leads can be 0.1" in conformance with accepted electronic industry's standards. The outside diameter of the contact 36A is only slightly smaller than the diameter of the counterbore 33A. It will be understood by those skilled in the art that when the screw 35 is turned all the way in, the contact 36A will be advanced in the direction of the counterbore 33A and eventually will come into contact with the lead ends in the counterbore 33A and press them in a manner comparable to a vise action against the flat bottom surface of said counterbore. The disc 36A is registered in assembly in such manner on the shank 35A that at point of contact with the various leads in the counterbore 33A, the segment 40A will straddle the ends of the leads 43A1 and 43A4 and the segment 40B the ends of the leads 43A2 and 43A3 connecting them respectively and electrically together. In an alternative arrangement, the segment 40A could connect the leads 43A1 and 43A2 and the segment 40B the leads 43A3 and 43A4.

The leads 43B1, 43B2, 43B3 and 43B4 are arranged in the counterbore 33B in the same manner as the leads 43A1, 43A2, 43A3 and 43A4 and controlled by the disc 36B to connect simultaneously the lead 43B1 to the lead 43B4 and the lead 43B2 to the lead 43B3. It will be understood, that when the leads of the array 42A are electrically connected, the leads of the array 42B are disconnected and vise versa. As seen from the foregoing description the switching device of FIGS. 11 and 12 has two contact positions in which alternatively either the leads of the array 42A or the array 42B are electrically connected.

The two switch positions in which contact is made are defined by a stop mechanism comprised of a metal pin 47 press fitted or cemented in the block 50 parallel to the screw 35 protruding above the surface of the block 50 and of a metal pin 48 press fitted into the head 35B of the screw 35. When the screw 35 is turned clockwise the pin 48 will hit the pin 47 from one side, but when it is turned counter clockwise it will hit the pin 47 from the other side, in either case acting as a stop and limiting the rotation of the screw 35 to somewhat less than three hundred and sixty degrees. Assuming the pitch of the screw 35 to be thirty two threads per inch, the axial travel of the contacts 36A and 36B from one contact position to the next will be about 0.025" which is adequate to prevent any unwanted electric discharge, from stationary to movable contacts. The exact length of travel of the contacts 36A and 36B will depend on the ratio of the sum of diameters of the pins 47 and 48 to the total travel of the pin 48 from one side of the pin to the other. It will be seen further that each switch positions is identified visually by the pin 48 being located either to the left or to the right of the pin 47 The switch described in reference to FIGS. 11–14 provides alternating on-off control of four separate circuits and could be classified as four circuit, alternating single pole, double throw switch. FIG. 15 is a schematic presentation of the switch of FIGS. 11–14. It will be seen that by connecting the leads A1 to A4 and B1 to B4 (dotted lines in FIG. 15), I create now a double pole double throw single circuit switch function which has a wide application in the electrical industry. It will be further understood that if, for example, the disc 36A were removed and the array of leads 42A eliminated altogether in the diagram of FIG. 15 the switch would function as two circuit, single pole, single throw switch. Upon further modification which will eliminate the groove 41 in the contact disc 36B and the leads 43B2 and 43B3, the switch would function as single pole, single throw, opening and closing the leads 43B1 and 43B4. The leads A1 . . . A4, B1 . . . B4 are equivalent to leads 43A1–4-3A4; 43B1–43B4 of FIGS. 11–12.

Thus, I have demonstrated that switch construction of FIGS. 11–15 can be used for different switch functions with only minor switch modifications.

Referring now to FIGS. 16 and 17 there is shown a metallic disc contact 51 controlled by an insulating screw 52 to assume any one of two contact positions as follows: In position #1, the contact 51 pressed against the wires 53A and 53B connecting them electrically together and in position #2 the contact 51 presses against the wire 53C and 53D also connecting them electrically together. The wires 53C and 53A are soldered or welded together at 54 thus providing a three wire single pole, double throw switch circuit. The contact 51 can be moved within the confines of a cavity 55 in a dielectric yoke 56 which is provided with a center tapped hole to guide movement of the screw 52. The wires 53A, 53B, 53C and 53D are inserted into the cavity 55 thru respective openings in the walls of the yoke 56 and cemented permanently therein. Those openings are arranged in one plane so that the wires 53A, 53B, 53C and 53D are also in one plane. The contact 57 can be cemented, press-fitted or pinned to the shank of the screw 52 which also prevents the removal of the screw 52 from the yoke 56. The height of the head of the screw 52 above the yoke 56 can be a visual indicator as to whether the contact 51 connects the wires 53A and 53B or the wires 53C and 53D. As an alternative, two colliding pins similar to the pins 47 and 48 in the arrangement of FIGS. 11 and 12 could be provided for visual indication of position of the contact 51.

LEAD-LESS SWITCH

I refer now to FIGS. 18, 19 and 20 representing a switch design essentially similar to the one described in reference to FIGS. 11–15, except that the switch is leadless, with user inserting component or circuit leads into openings provided therefore and then, when needed, connecting them electrically by actuating switch contacts with individual component parts similar to those of FIGS. 11 and 12 being assigned same designation numerals. Switch frame 60 is similar to the block 50 in FIGS. 11 and 12, except that it is provided with four openings 61A, 61B, 61C and 61D extending the entire width of the frame 60 while openings for the leads 43A2, 43A3, 43B2 and 43B3 of FIGS. 11 and 12 are eliminated altogether. Wires inserted into an opening 61A or 61B on the right hand side of the frame 60 will be guided along respective even depth grooves 62A and 62B provided therefor at the bottom surface of the counterbore 33A and come out at the other side thereof. The same applies to wires inserted into openings 61C and 61D except that they are threaded through a counterbore 33B. The threading of wires through openings 61A, 61B, 61C and 61D is done when the contacts 36A and 36B are half way between positions #1 and #2. The contacts 36A and 36B used in embodiments of FIGS. 18–20 are similar to those employed in the design of FIGS. 11 and 12, except that they have no grooves 41 seen in FIG. 13, all the other details of construction being the same as described in reference to FIGS. 11–15.

Figures 21, 22, 22A, 22B, 22C, 23, 24, 24A, 25, 26, 27:
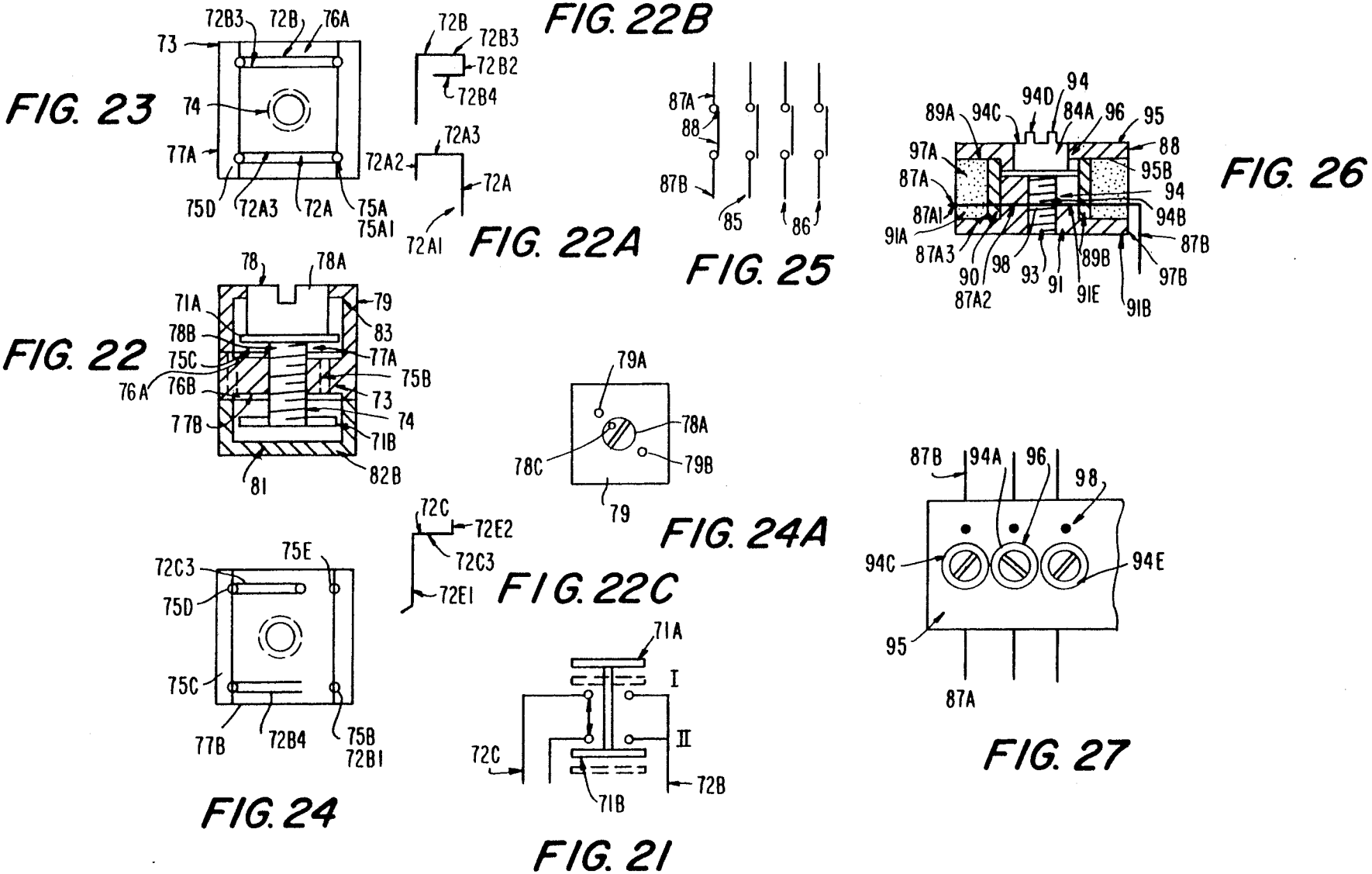
FIG. 21 is a schematic of a single pole double throw switch according to the invention.
FIG. 22 is a secitonal view of the switch less stationary contacts according to FIG. 21.
FIG. 22*a* is a plan view of stationary contact 72*a* according to FIG. 21.
FIG. 22*b* is a plan view of stationary contact 72*b* according to FIG. 21.
FIG. 22*c* is a plan view of stationary contact 72*c* according to FIG. 21.
FIG. 23 is a top view of switch's contact plate 73 with contacts installed according to FIG. 22.
FIG. 24 is a bottom view of switch's contact plate 73 with contacts installed according to FIG. 22.
FIG. 24*a* is a top view of switch assembly according to FIG. 22.
FIG. 25 is a schematic of an assembly of single pole single throw switche according to the invention.
FIG. 26 is a sectional view of a switch of FIG. 25.
FIG. 27 is a top view of the assembly according to FIG. 25.

Reference is now made to FIGS. 21; 22; 22*a*; 22*b*; 22*c*; 23; 24; and 24A which show another embodiment of a two position, single pole, double throw switch according to the invention. The schematic of FIG. 21 shows a pair of movable contacts 71A and 71B which in position #1 connect respectively the lead 72A to lead 72B and in position #2 the lead 72B to the lead 72C. The mechanical arrangement of the switch shown in FIGS. 22, 23 and 24 consists of a square dielectric plate 73 having a tapped hole 74 through center; four holes 75A, 75B, 75C and 75D through respective plate corners; a hole 75E through located between the holes 75A and 75D; seen in FIG. 24 milled out section 76A in plate upper face 77A and similar milled out section 76B in plate bottom face seventy seven B. A screw 78 made of dielectric material comprised of head 78 A and shank 78B can be moved up and down the axis extending through center of the hole 74 as the screw 78 is rotated in one or the other direction. A pair of conductive washers 71A and 71B is mounted respectively, the first one under the head 78A and the other one at the end of the shank 78B by threading, by press fit with cement or by pinning (not shown) or by still other suitable means. The contact 71A and the bottom portion of the head 78A are enclosed within a counterbored plate 79 similar in its outside dimensions to plate 73. Similarly, the contact 71B and the bottom portion of the shank 78B are enclosed within a counterbored plate 81 similar to plate 79. The plate 79 is cemented to the top of the plate 73 and the plate 81 to the bottom thereof. The plate 79 has a center hole 83 for access to the head 78A with a screw driver (not shown) and the plate 81 has three corner holes 82A, 82B, and 82D lining up with respective holes 75A, 75B and 75D in the plate 73 for passing the leads 72A, 72B and 72C.

Referring to FIG. 22 A the lead 72A is "U" shaped, with the leg 72 A1 being considerably longer than the other leg 72A2. The lead 72A is mounted within the switch frame in such a manner that the leg 72 A1 protrudes outwardly through respective holes 75A and 82A while the leg 72 A2 is anchored and cemented within the hole 75D, without projecting into the milled out section 76B. The lead 72B shown in FIG. 22B is "P" shaped with the leg 72B1 protruding outwardly thru the holes 75B and 82B and the connecting section 72 B2 extending thru the holes 75C from the milled out section 76A to the milled out section 76B, and then bent at right angle to provide the wrap around section 72B4. And finally the lead 72C seen in FIG. 22C is comprised of three sections 72 C1; 72 C2 and 72 C3 and has its section 72 C2 anchored and cemented in the hole 75E located close to hole 75A, between the holes 75A and 75D, while its section 72C1 protrudes outwardly thru opening 82D in the plate 81.

It is understood that the connecting sections 72A3 and 72B3 are parallel to each other and that they extend even amount above the bottom of the milled out section 76A on which they are disposed and that the connecting section 72B3 is parallel to and of same height as the wrap around section 72B4. It is further understood that the diameter of the contact washers 71A and 71B is larger than the spacing between respective sections 72A3; 72B3, 72B4 and 72C3. It follows that when the screw 78 is turned all the way in, the contact washer 71A clamps the sections 72A3 and 72B3 against the milled out section 76A and thus connects the leads 72A and 72B electrically together. Conversely, when the screw 78 is turned all the way out, the contact washer 71B clamps the sections 72C3 and 72B4 against the bottom of the milled out section 76B thus connecting the leads 72B and 72C electrically together. It is understood that the leads 72A, 72B and 72C are made of even diameter copper wire or other electrical conductor and have flexibility to yield resiliently to pressure exerted by the washers 71A and 71B. The screw head 78A may be marked with a color dot 78C lining up in closed contact position with one or the other color dots 79A and 79B provided in assembly in the top face plate 79 spaced approximately one hundred and eighty degrees. It is understood that the switch of FIGS. 22–24 can be used for single pole, single throw functions as is or with the elimination of the contact 71B the lead 72C and bottom plate 81.

Reference is made now to FIGS. 25, 26, and 27 which describe an assembly 85 of several independently operated single pole, single throw switches 86, each comprised of a pair of stationary identical contacts 87A and 87B and of a movable contact 88 adapted to connect or disconnect the former electrically. The stationary contacts or leads 87A are round, flexible copper wires mass produced by cold-heading process, each comprised of a long section 87A1, short section 87A2 and a flange 87A3 separating the sections 87A1 and 87A2. The contacts 87B are identical to contacts 87A and their corresponding component parts are identified 87B1; 87B2; and 87B3. A dielectric plate 89A is provided with an array of uniformly spaced in-line holes 90 in which the lead sections 87A2 are cemented or press fitted up to their flanges 87A3. An identical plate 89B is provided with an array of similarly spaced leads 87B. The plates 89A and 89B are positioned on a dielectric shouldered strip 91, perpendicularly thereto, in such manner that each lead 87A is located exactly vis a vis a corresponding lead 87B. The strip 91 is provided with a pair of milled out shoulders 91A and 91B and with an array of uniformly spaced tapped holes 93 located along the center of the unmilled section 91C of the strip 91 inline with and in between each pair of corresponding leads 87A and 87B. Screws 94 made of dielectric material cooperate threadingly with respective tapped holes 93, each screw 94 being provided with a conductive washer 88 mounted on its shank 94B underneath the head 94A. The depth of the mill in the shoulders 91A and 91B is such that the lead sections 87A2 and 87B2 extend directly above and in close proximity to the strip section 91C, practically touching it and up to the edge of respective holes 93. It is understood that when the screw 94 is turned clockwise all the way in, the washer 88 will press against the sections 87A2 and 87B2 clamping them against the section 91C and connecting them electrically together. Conversely when the screw 94 is turned counterclockwise the washer 88 is removed and the electrical connection between the contacts 87A and 87B is broken. A shouldered strip 95 having shoulders 95A and 95B and being similar to strip 91 is mounted parallel to strip 91 on top of the plates 89A and 89B and provided with uniformly spaced through holes 96 for accessing respective screws 94. The void area 97A between the plate 89A and the shoulders 91A and 95A is filled with dielectric liquid filler such as epoxy, hardening upon application, holding all the assembly parts rigidly together and preventing removal of leads 87A. The void area 97B between the plates 89B and the shoulders ninety one B and ninety five B, is similarly filled with epoxy. Each of the tapped holes 93 is provided with a relief counterbore 98 at the top of the section 91C having diameter equal to or slightly larger than the diameter of the screw shanks 94B. The length of the screw 94 including its head 94A is such that when it is turned all the way counterclockwise, the bottom section of its shank 94B becomes disengaged from the threads of the tapped hole 93 and rests within the counterbore 98 while the washer 88 reaches the strip 95 underneath the hole 96.

It is understood that if the screw 94 should be turned further counterclockwise it will now exert any pressure on the strip 95 because its threads are in the counterbore 98 disengaged from the tapped hole 93. For PCB applications the leads 87A1 and 87B1 can be bent at right angle. The head 94A of the screw 94 comprises of a flat annular section 94C provided with a color dot 94E and a slotted round boss 94D in the center thereof. To close contacts, switch screw 94 is turned clockwise by a screw driver (not shown) engaging the slotted boss 94D until tightness develops combined with the dot 94E lining up with a marker 98 imprinted on the strip 95 at the upper edge of respective holes 96. The first two switches from the left in FIG. 27 are shown in closed contact position. In open contact position the location of the dot 94E is random.

Figure 28:
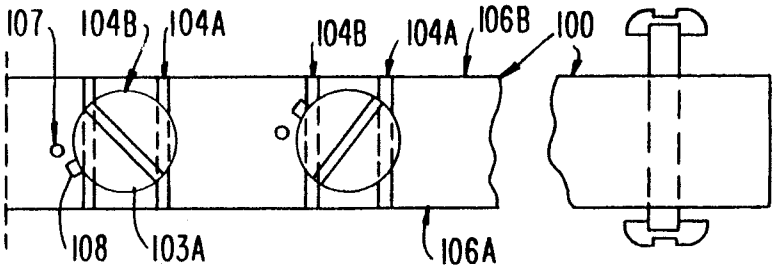
FIG. 28 is a plan view of a connector employing screw controlled contacts according to the invention.
Figure 29A:
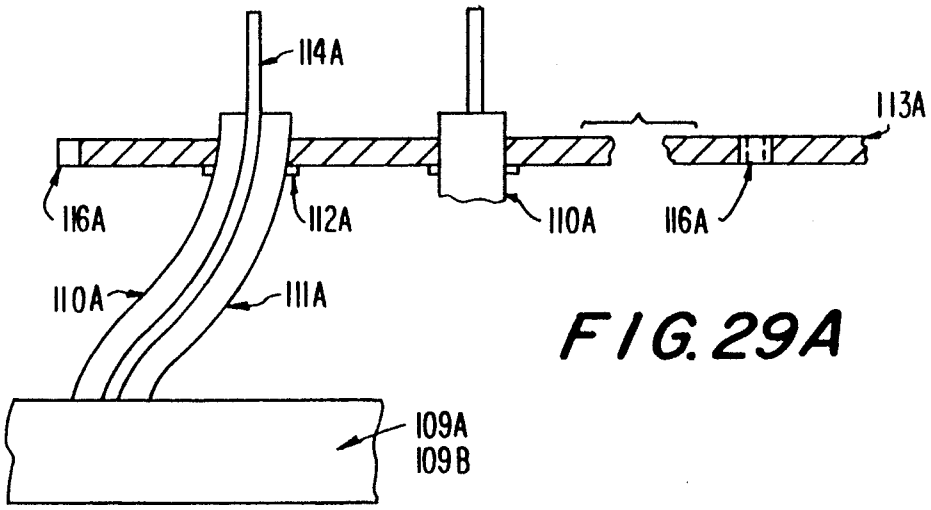
FIG. 29*a* is a sectional view of a harness strip used in conjunction with the structure of FIG. 28.
Figure 29:
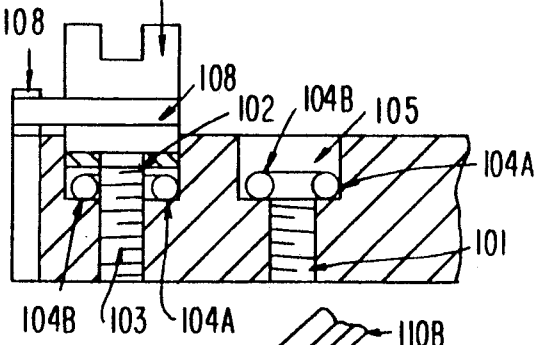
FIG. 29 is a sectional view of the connector strip according to FIG. 28.
Figure 29B:
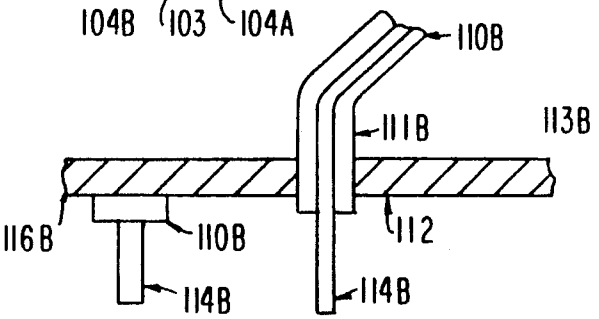
FIG. 29*b* is a sectional view showing a harness strip used in conjunction with the structure of FIG. 29.

I refer now to FIGS. 28 and 29 which show an insulating connector strip 100 provided with an in line array of tapped holes 101 spaced at a uniform distance from each other, each tapped hole 101 having a counterbore 105 at its upper end. The counterbores 105 house respective contact discs 102 each mounted fixedly on a shank of an insulating screw 103, each of the latter moveable in respective holes 101. A pair of parallel holes, perpendicular to the holes 101 extend through each counterbore 105 from one side 106A of the strip 100 to the other side 106B thereof, the hole on the left hand side of each screw 103 designated as 104B and the hole on the right hand side of each screw 103 as 104A. The rotation of the screw 103 is limited to somewhat less than one complete turn through the expedient of two colliding pins, the pin 107 in the strip 100 and the pin 108 in the head 103A of the screw 103. The overall arrangement is essentially similar to what was described in reference to FIGS. 18, 19 and 20, therefor detailed description of the operation thereof is dispensed with. The purpose of the strip 100 is to faciliate the connection of individual wires 110A and 110B in a pair of similarly constructed multiwire cables 109A and 109B. Each wire 110A in the cable 109A consists of a wire shaped conductor 114A in a jacket 111A, the latter made of vinyl or some other insulating substance which is uniformly stripped off at one end leaving bare, uninsulated conductors 114A exposed. The insulation-covered wires 110A are cemented in line in respective holes 112A in a dielectric harness strip 113A. The spacing of respective inline holes 112A is identical to the spacing of the holes 104A in the connector strip 100 and the diameter of the conductor wires 114A is somewhat smaller than the diameter of the holes 104A. The length of the bare conductor wires 114A is slightly less than the width of the connector strip 100. The harness strip 113B is essentially similar to the strip 113A, with its bare conductor wires 114B being spaced from each other a distance equal to spacing of holes 104B in the connector strip 100. Registry screws 115 screw into both sides 106A and 106B at respective ends of connector strip 100 and line up with respective holes 116A and 116B in the harness strips 113A and 113B. It will be understood by those skilled in the art that when the strips 113A and 113B are placed against respective sides 106A and 106B of the strip 100 with screws 115 registering with the holes 116A and 116B, the wires 114A will extend into the holes 104A and the wires 114B into the holes 104B.

It will be further understood that any pair of wires 114A and 114B passing through the same cavity 105 will be connected electrically together by a turn of the screw 103 which causes the contact 102 to press simultaneously against the surfaces of both the wires 114A and 114B while the stop pin 108 collides with the pin 107.

I refer now to the embodiment of FIGS. 30–34 describing a variable resistance/voltage divider employing screw actuated switches according to the invention. The schematic of FIG. 30 shows a pair of resistance arrays 175A and 175B comprised respectively of twelve series connected resistances 173A and 173B. In our example, the array 175A has two input terminals 172A1 and 170A2 and is comprised of twelve following value resistances 173A: 1K;-1K-2K-5K-100-100-200-500-10-20-20-50. The resistances 173B in the array 175B are identical to resistances 173A and are connected in the same order as the resistances 173A between input terminals 172B1 and 172B2. Thus, for each resistance 173A in the array 175A there is an equal value twin resistance 173B in the array 175B. The terminals 172A2 and 172B2 are connected to an output terminal 172C. It is seen that the resistance of each of the arrays 175A and 175B as measured between respective terminals 172A1–172A2 and 170B1–172B2 is ten thousand ohms. Each pair of equal twin resistances 173A and 173B in respective arrays 175A and 175B is controlled by a switch 178 which shunts one of them while leaving the other one in the circuit of the divider. It follows that only one half of the divider resistances in both arrays 175A and 175B remain in the circuit, while the other half is shorted out by switches 178. It further follows that the sum of the "on" resistances in both the arrays 175A and 175B as measured between divider terminals 172A1 and 172B1 is ten thousand ohms at all times irrespective of the actual position of individual switches 178. In dividers having decimal value of total resistance, the resistance pattern in the last decade is 1-2-2-5, and it can be adjusted from 0 to 10 in unit steps while resistance patterns in all other decades is 1-1-2-5, or 0 to 9. Both 0 to 9 and 0 to 10 decades are adjustable in unit steps. When the total divider resistance is other than decimal, binary resistance patterns are also possible. Thus, the resistance of the array 175A can be adjusted in one thousand steps of ten ohms each to any intermediate value of up to ten thousand ohms by the action of respective switches 178. Having met the requirements of a constant total resistance between voltage divider input terminals 172A2 and 172B1 and adjustability over the whole divider resistance range in steps of smallest divider resistance, the device of FIG. 30 qualifies as combination voltage divider and variable resistance. It is understood that the invention is not limited either to resistance decades, nor to resistance values on which the example was based. The electromechanical embodiment of the schematic of FIG. 30 is shown in reference to FIGS. 31–34. FIG. 31 shows a perspective view of a rectangular shaped voltage divider housing. 184 made of dielectric material, provided with a front panel 184A, the latter provided with two parallel, staggered rows of circular openings 185. Each opening 185 contains the head 176A of an actuating screw 176 made of dielectric material and is marked by a legend 189 imprinted on the panel 184A in close proximity to respective openings 185 designating either resistance value controlled by that respective screw or a symbol therefor. A screwdriver (not shown) may be inserted into respective openings 185 to adjust respective actuating screws 176 in the housing 184. Switch dimensional parameters are such that any one of screw heads 176A is level with the housing panel 184A when the switch 178 of FIG. 30 shorts out a respective resistance in the array 175A but protrudes out beyond the panel 184A when the switch 178 shorts out a resistance of the array 175B. I refer now to FIGS. 32, 33 and 34 which show a rectangular shaped dielectric panel 183 cemented to internal walls of the housing 184, parallel with the panel 184A creating a cavity 187A within the housing 184. The panel, 183 has two long and two short edges 183A and 183B, respective faces 186A and 186B, twelve rows 180 of five through holes parallel to the edge 183B comprised of two outside holes 181A, two inside holes 181B, a tapped hole 191 and of twelve uniformly spaced grooves 170 in the face 186. A along the center line of each row of holes 180.

It will be seen that each row of holes 180 is associated with the control of a specific pair of twin resistances 173A and 173B. Second cavity 187B bound by the face 186B of the panel 183, the walls of the housing 184 and rear panel 184C is used for storage of discrete resistances 173A and 173B. It will be seen that the arrays 175A and 175B are arranged in two separate layers on top of a "U" shaped support 192 with same value twin resistances 173A and 170B being mounted one on top of another. It will be be further seen that the leads 171A1 171A2 of a resistor 173A are passed through respective holes 181A and the leads 171B1 and 171B2 of twin resistor 173B which is of the same value but in the array 175B are inserted into the holes 181B, but do not go through lest they touch leads 171A1 or 171A2. Referring to FIG. 34, the face 186B of the panel 183 is laminated with a thin conductive layer of copper separated by insulation gaps 177, 177A and 177B at right angle to each other into interconnecting links 174A and 174B to which respective resistor leads 171B1 and 171B2 are soldered. The insulation gaps or copper separations 177 and 177A are parallel to the edges 183A and the gaps 183B to the edges 177B. The gaps 177 and 177A extend the whole length of the face 186B while the lateral gaps 177B extend only one half of the width of the panel 183 or so. The gap 177 extends along center line of face 186B and the gaps 187A at the left and right sides thereof. It is seen that the links 174A connect respective adjacent resistances 173A in series and similarly the links 174B connect adjacent resistances 173B in series. The output terminals 172A1, 172B1 and 172C are rigid brass pins press fitted into copper covered surface 186B of the panel 183 and then soldered in place. The pins 172A2 and 172B2 have been substituted by the output pin 172C half way across the gap 177A located on the right hand side of the drawing 34 thus connecting together the end links 174A and 174B. The pins 174A1, 172B1 and 172C protrude outwardly through appropriate openings in the rear panel 184C and serve as divider terminals for connecting external voltage source to the arrays 175A and 175B.

The selective shorting out of individual resistances 173A and 173B in respective arrays 175A and 175B is accomplished by means of respective contacts 179A and 179B in form of washers made of electrically conductive material. The washer 179A is mounted permanently by cement, threaded engagement, press fit or pinning (not shown) or any combination of the above on the shank 176B of a nylon screw 176 underneath the head of the screw 176A. The screws 176 cooperate threadedly with respective tapped holes 191 arrayed for compactness in a staggered pattern along the center lines of respective grooves 170. Since the depth of the grooves 170 is uniform and equal to approximately one half of the diameter of the wires 171A1 and 172A2 the leads 171A1 and 172A2 will protrude above the face 186A of the panel 183. The length of the leads 171A1 and 171A2 is so dimensioned that they extend from both ends of the groove 170 up to the very edge of the tapped holes 171. The outside diameter of the contact washers 179A is somewhat larger than the diameter of respective heads 176A of screws 176. It is obvious that when the screw 176 is screwed all the way into its tapped hole 191, the contact 179A will exert pressure on respective leads 171A1 and 171A2 at opposite sides of the tapped hole 191 and connect them electrically, thus shorting out a respective resistor 173A in the array 175A. The contact washers 179B are mounted permanently in a manner similar to washers 179A at the end of respective screw shanks 176B. When the screw 176 is screwed all the way out, the washer 179B presses against a pair of respective copper links 174B located at opposing sides of the center gap 177, thus shorting out a respective twin resistance 173B. It is understood the tapped holes 191 although staggered, are close to the center line of the panel 183 and that the diameter of the contact 179B is large enough to bridge across the center gap 177. The support 192 is cemented of otherwise attached to the face 176B enclosing the contacts 179B and acting as a mounting pad for the resistances 173A and 173B. Thus, our objective of selectively shorting out one of two equal and corresponding twin resistances 173A and 173B in their respective arrays 175A and 175B has been accomplished by a mere few turns of a screw in either one or the other direction.

Figure 36:
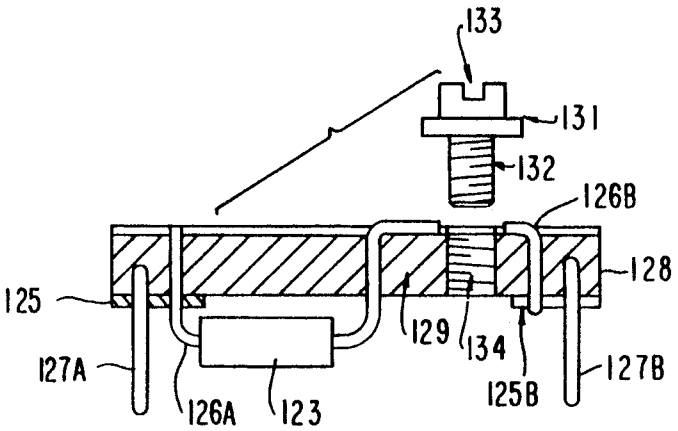
FIG. 36 is a plan view of capacitance decade according to FIG. 35.
Figure 35:
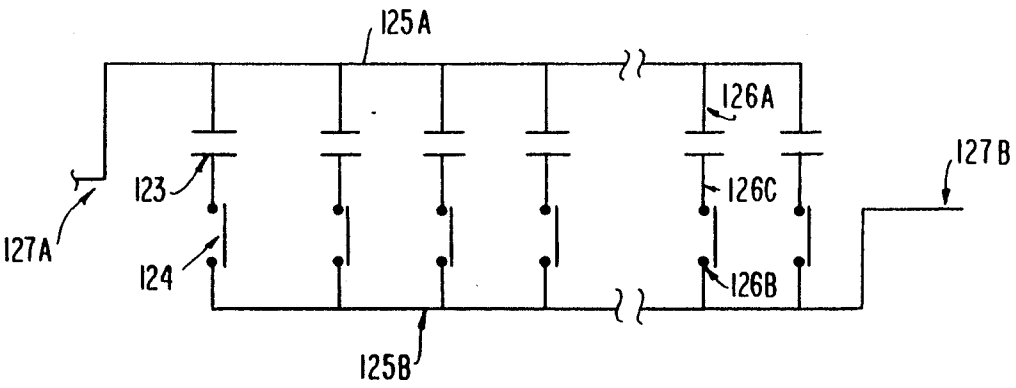
FIG. 35 is a schematic of a capacitance decade circuit according to the invention.

The device described in reference to FIGS. 30-34 lends itself, when modified to other uses which are described below:

a. Application as variable resistance but not as voltage divider by eleimination of resistance array 175B, copper links 177B, and terminals one 172B1 and 172B2.

b. Application as an inductance decade by substituting inductances for resistances in the example "a" above.

c. Application as a single pole, single throw, multiposition dip switch by elimination of resistance arrays 175A and 175B, copper links 174A and 174B, terminals 172A1, 172B1 and 172C, rear panel 184B and compartment 187B. The leads 171A1 and 171A2 are anchored in the grooves 170 with cement and protrude outwardly for mounting the switch on a printed circuit board. Any pair of leads 171A1 and 172A2 can be shorted by the screw contact 179A.

d. Application as capacitance decade according to schematic diagram of FIG. 35 which shows several capacitors 123 connected in shunt via respective screw controlled switches 124. Depending on whether a particular switch 124 is "on" or "off", a respective capacitor 123 is either connected into the decade circuit or disconnected therefrom. It is known that by connecting capacitances in shunt their respective values are added together, which is analogous to connecting resistances in series. In the example of FIGS. 35 and 36, the pattern of individual capacitances values may be analogous to the pattern of resistance values in FIGS. 30–34, namely in decimal multiples of 1; 2; 2 and 5 for the last decade and 1; 1; 2; 5 for all the preceeding decades. The common bus bar 125A is connected to the output terminal 127A and ties together the legs 126A of the various capacitances 123 in the circuit, while the other bus bar 125B is connected to the output terminal 127B and ties together the leg 126B of respective switches 123 The mechanical embodiment of FIG. 36 is analogous to the voltage divider embodiment of FIG. 32 except for connection of circuit components in shunt instead of in series. FIG. 36 refers therefor to only those mechanical details which are different from FIG. 32 yet necessary for the understanding of the operation of the capacitance decade as compared to the operation of the resistance decade of FIGS. 30–34. 128 is an insulating board analogous to panel 183 in FIG. 32 having two copper bus bars 125A and 125B, laminated to one of its large surfaces, extending the entire length of the board 128. One of capacitance lead 126A is soldered to the bus bar 125A, while the other lead 126C is passed through a respective hole 129 in the board 128 and bent at right angle into a groove 130 analogous to groove 170 in FIGS. 30–34. A wire lead 126B of same diameter as the lead 126C is soldered to the bus bar 125B, passed through a hole in the board 128 and also bent into the groove 130. The leads 126B and 126C can be connected together by the action of a metal contact disc 131 mounted fixedly on a shank 132 of a dielectric screw 133. The shank 132 cooperates threadedly with the threads of a tapped hole 134 located in the board 128 between the leads 126B and 126C. When the screw 133 is turned clockwise all the way into the tapped hole 134 the contact 131 exerts simultaneous pressure on both the wires 126B and 126C and connects them electrically together, thus switching a respective capacitor 123 into the decade circuit. When the screw 133 is turned counter-clockwise, the connection is broken and the capacitor 123 is disconnected from the decade circuit.

I claim:

1. In a screw-operated electrical contact device including an enclosure made of dielectric materials providing walls having at least one internal flat surface, a group comprised of at least one pair of electric conductors disposed on, parallel to and projecting evenly above said surface and protruding outwardly through said walls, there being an insulating gap separating said conductors from each other, nut means in said enclosure aligned with said gap having an axis perpendicular to said surface, a screw member in said nut means adapted to be moved axially relative to its own rotation about said axis as a result of its threaded engagement with said nut means, and a conductive member wider than said gap mounted on said screw member and adapted to be advanced toward said surface and exert simultaneous pressure on both of said conductors by clamping them to said flat surface or to be moved away therefrom, as a function of axial displacement of said screw member in either direction, the improvement comprising: said pair of conductors being a first pair, and including a second pair of conductors on said surface wherein said conductive member provides first and second conductive surfaces, insulated from each other, adapted to engage or disengage respective first and second pairs of conductors on said surface.

* * * * *